US005316221A

United States Patent [19]

Glover et al.

[11] Patent Number: 5,316,221

[45] Date of Patent: May 31, 1994

[54] FLUID DISPENSER HAVING DEFORMABLE CONTAINER PRESSURIZED BY LEAF SPRINGS

[75] Inventors: Paul A. Glover, Loughborough; Brian R. Law, Leicester, both of England

[73] Assignee: Chesebrough-Pond's USA Co., Division of Conopco, Inc., Greenwich, Conn.

[21] Appl. No.: 11,011

[22] Filed: Jan. 29, 1993

[30] Foreign Application Priority Data

Jan. 31, 1992 [GB] United Kingdom ..... 9202149

[51] Int. Cl.[5] ..... B05B 5/035; B05B 11/04

[52] U.S. Cl. ..... 239/708; 239/328; 222/95; 222/190; 222/509

[58] Field of Search ..... 239/690, 708, 320, 321, 239/323, 328; 222/95, 386.5, 509, 505, 190

[56] References Cited

U.S. PATENT DOCUMENTS

| | | | |
|---|---|---|---|
| 1,663,678 | 3/1928 | Byerly | 222/95 |
| 4,121,737 | 10/1978 | Kain | 222/95 |
| 4,315,732 | 2/1982 | Rowbottam et al. | 239/328 |
| 4,981,238 | 1/1991 | Wenmaekers | 222/95 |
| 5,060,700 | 10/1991 | Wenmaekers | 222/386.5 |
| 5,221,050 | 6/1993 | Jeffries et al. | 239/323 |

FOREIGN PATENT DOCUMENTS

| | | | |
|---|---|---|---|
| 0240454 | 9/1989 | Japan | 222/95 |

*Primary Examiner*—Karen B. Merritt
*Attorney, Agent, or Firm*—Milton L. Honig

[57] ABSTRACT

A fluid dispenser is provided with a carrier having a deformable container capable of being filled with a fluid material to be dispensed, the container being sealed by a closure valve device, with resilient device acting upon the container to place its contents under pressure, and a control device being provided for opening of the closure valve device to permit contents of the container to be ejected by pressure from the resilient device.

7 Claims, 4 Drawing Sheets

FLUID DISPENSER HAVING DEFORMABLE CONTAINER PRESSURIZED BY LEAF SPRINGS

BACKGROUND OF THE INVENTION

1. Field of the Invention

This invention relates to dispensers for fluid materials. It is particularly but not necessarily concerned with dispensers from which the material is ejected as a spray.

2. The Related Art

Aerosols which are used to spray a fluid material from a dispenser suffer from a number of disadvantages, including the adverse environmental effect of the propellant gases used, the high proportion of the total capacity of the dispenser that is sometimes needed for the propellant, and the difficulty of maintaining the spray pressure as the contents of the dispenser are used up. The disposal of the partly empty dispensers can also be a hazard because of the pressurized gases they contain. The present invention is concerned with a novel form of dispenser in which at least some of these disadvantages can be avoided.

SUMMARY OF THE INVENTION

According to the invention, there is provided a fluid dispenser comprising a carrier provided with a deformable container capable of being filled with a fluid material to be dispensed, the container being sealed by closure valve means, with resilient means acting on the container to place its contents under pressure, and control means being provided for opening the closure valve means to permit contents of the container to be ejected by the pressure from the resilient means.

The container is conveniently in the form of a flexible walled and preferably elongate sac optionally made of a plastics material. The resilient means may then take the form of at least one leaf spring which is preloaded to bear against the flexible sac. If the one leaf spring extends over substantially the entire length and breadth of the sac it can be arranged that it will expel substantially the entire contents of the sac by the pressure it applies.

In one arrangement the flexible container is held between a pair of symmetrically disposed springs which squeeze the sac between them. In an alternative arrangement, the container is gripped between a spring and a non-resilient backing surface.

A disadvantageous feature of some aerosol dispensers is the difficulty there is of controlling the direction of an aerosol spray for many purposes, which leads to waste. It is known, however, to influence the deposition of a spray onto a chosen surface by creating an electrostatic charge between the spray and the surface and the present invention is also concerned with dispensers which can make use of this effect to dispense personal products. In a further feature of the invention, therefore, the dispenser has a spray outlet through which the pressurized material is dispensed, and voltage generating means are provided actuatable by the operation of the control means to apply an electrostatic charge to the material being dispensed.

BRIEF DESCRIPTION OF THE DRAWING

By way of example, the accompanying drawings illustrate one form of dispenser according to the invention.

In the drawings.

DETAILED DESCRIPTION

Figure 1:
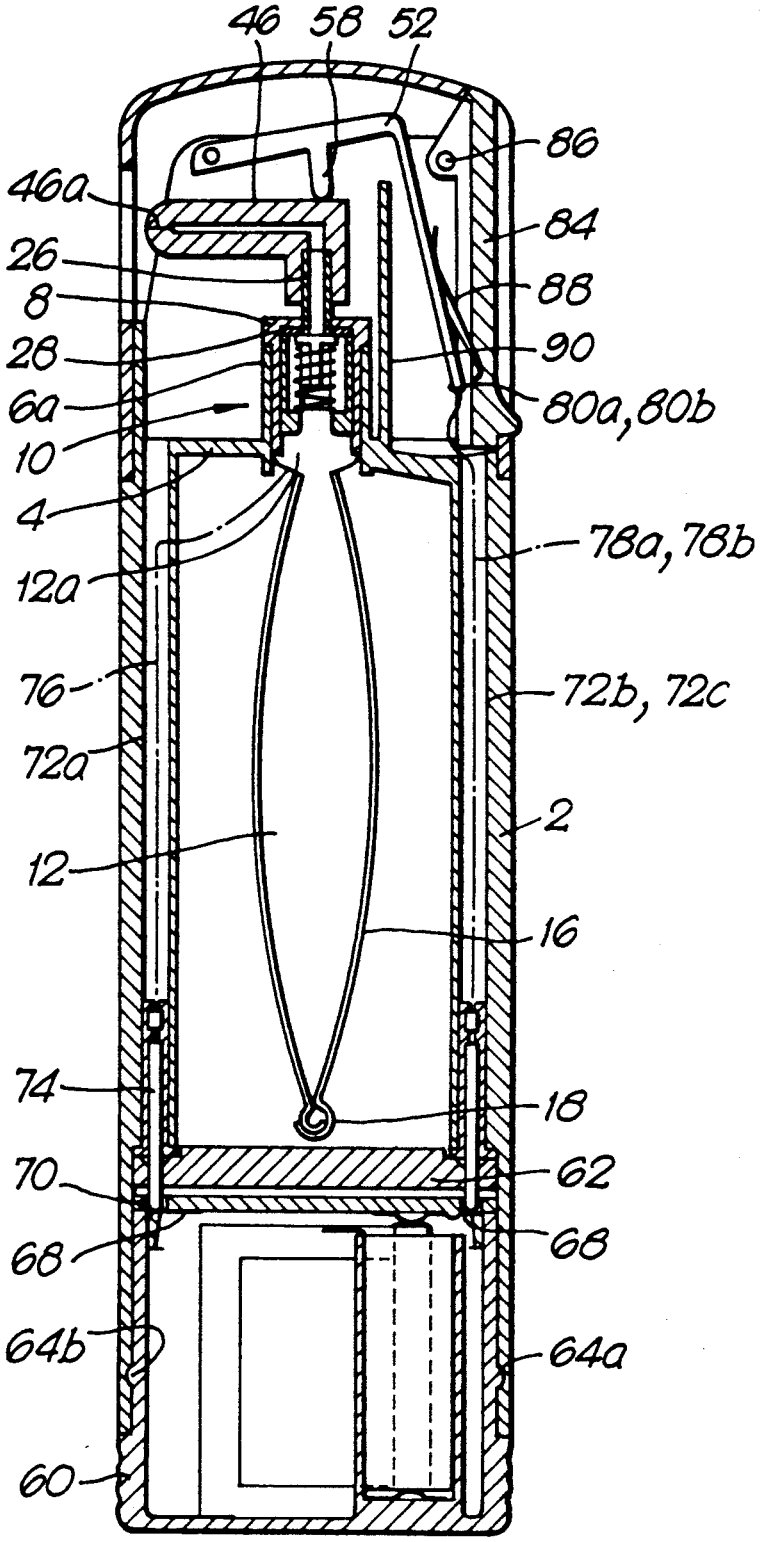
FIGS. 1 and 2 are mutually transverse axial sections of the dispenser.
Figure 2:
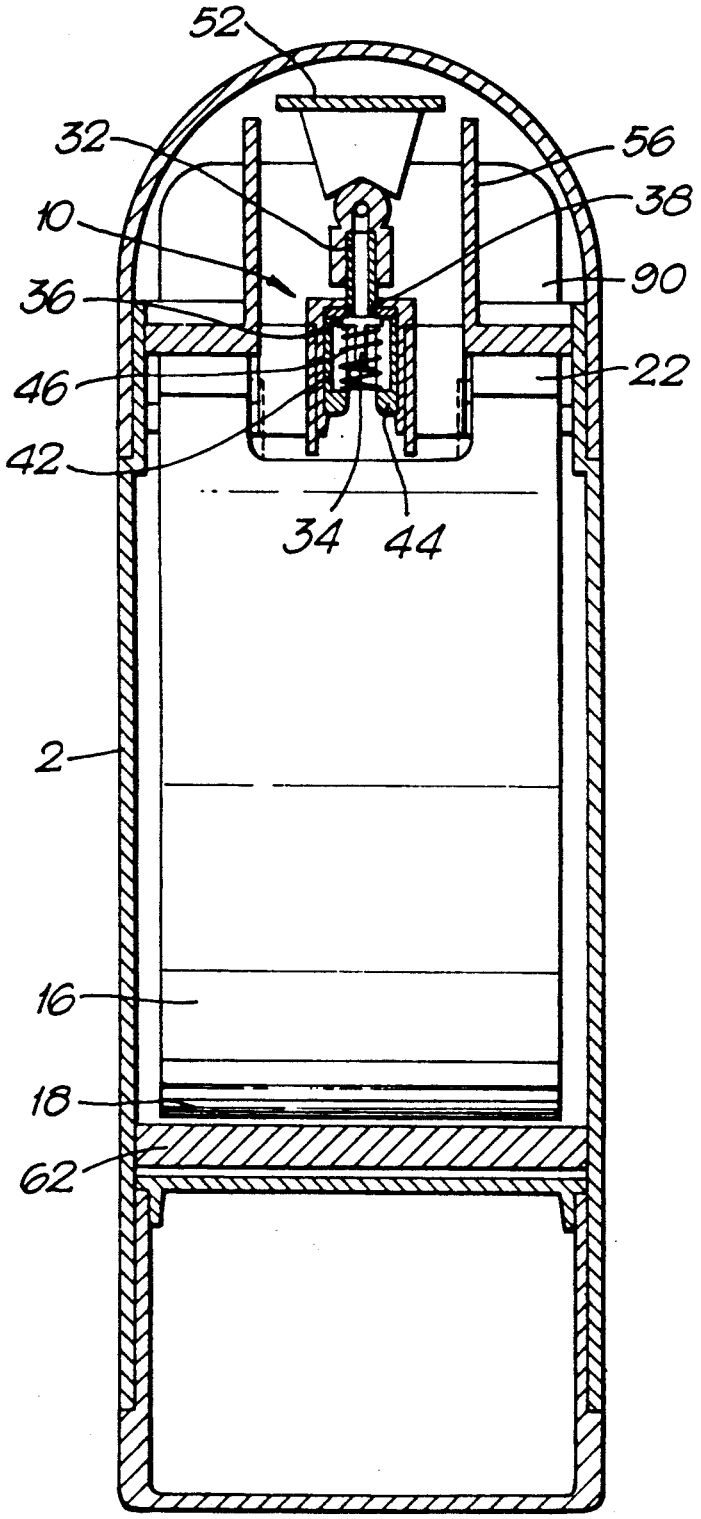

The dispenser illustrated comprises an outer casing 2 having an integrally formed slotted partition 4 near its upper end. The partition is in two parts spaced from each other by a central slot extending along the major central axis of the casing transverse cross section. Flanges 6 project upwards from the opposed edges of the two parts of the partition. At the central region of the slot, the flanges are part-circular in plan to form a close-fitting receptacle **6*a* for a cylindrical housing 8 of an outlet valve 10 that is secured to hollow cap 12*a* of a flexible container 12. To each side of this central region the flanges 6 are parallel to each other and shoulders 14** extend inwards from the lower ends of the flanges, narrowing the slot.

Figure 3:
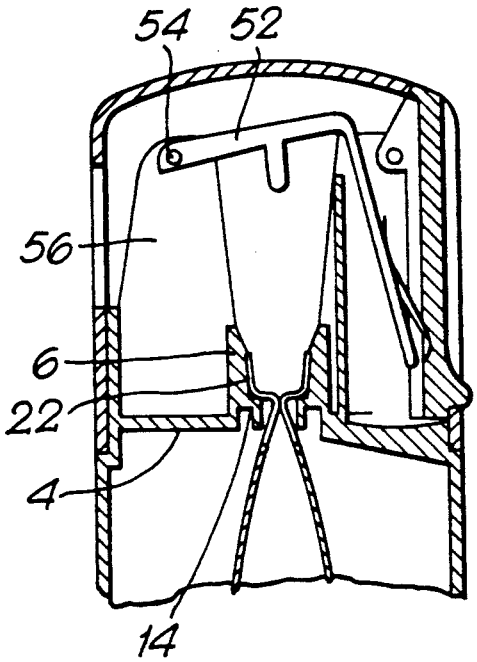
FIG. 3 is a section of the upper region of the dispenser in a plane parallel to the plane of FIG. 1.
Figure 4:
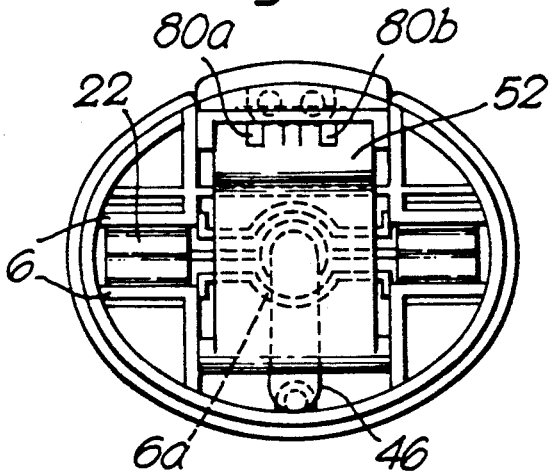
FIG. 4 is a top plan view of the dispenser with the of the casing omitted.

The container 12 is in the form of a flexible sac containing the fluid material to be dispensed and communicates with the outlet valve through the cap **12*a*. The sac 12 is held under pressure by a pair of leaf springs 16 bearing on it from opposite sides, each spring extending the length and breadth of the sac. The two springs 16 are locked together by return bends 18 on their ends below the sac. At the top of the sac the springs are bifurcated to leave clearance for the outlet valve 10 and container cap 12*a*. On each side of the housing 8 the bifurcated end portions 22 (FIG. 3) of the springs fit between the flanges 6 and, with the sac 12, are locked into place by the shoulder 14**.

In the relaxed condition each spring 16 curves in the opposite direction to that shown in FIG. 1. When the dispenser is assembled, the lower ends of the springs are first joined together by the return bends 18 and the sac 12 is placed between them. The springs are then flexed in the opposite direction to their relaxed curvature to bring end portions 22 together and are secured into place between the flanges 6. The flexure of the springs causes them to apply pressure to the contents of the sac 12, over the entire length and breadth of the sac. By appropriate design of the contour of the springs in their relaxed state it is possible to ensure that substantially the whole of the contents of the sac are able to be expelled by the pressure of the springs, ie. that as material is expelled and the springs come together they leave no significant hollows between them.

Release of the pressurized material from the sac is controlled by the outlet valve 10 which may be in the form of a conventional aerosol valve in which a valve body 26 projects through a central opening of the cap-like housing 8 and engages an elastomeric annular seal 28 surrounding a central opening in the top of the housing 8 to maintain the outlet normally closed.

The valve body comprises an upper tubular portion 32 and a lower guide stem 34 with a collar portion 36 between them. The upper face of the portion 36 urged against the seal 28 which also engages the outer periphery of the tubular portion 32 which has cross bores 38 to its interior immediately above the collar portion: in this state the valve is closed. The seal 28 is held in place by a tubular liner 42 which comprises an inwardly projecting shoulder 44. A compression spring 46 between the shoulder 44 and the valve body collar portion 36 provides the biasing force which holds the collar portion against the seal 28. A spray nozzle 46 is secured to the upper end of the valve body tubular portion 32.

An operating member 52 is mounted in the casing 2 on a pivot 54 supported by side walls 56. The member 52 is shown in its rest position with an integral contact bar 58 bearing without pressure on the spray nozzle 46 fixed to the valve body 26. When the member 52 is pivoted downwards the bar 58 depresses the valve body against its spring bias. The collar portion 36 moves away from the seal 28 and the cross bores 38 in the tubular portion 32 are brought into communication with the valve housing interior into communication with the valve housing interior below the annular seal 28. The material held under pressure in the sac is then ejected through the outlet valve.

It is known that if an electrical charge is given to a spray and an object to be sprayed is earthed or grounded the spray particles are attracted to the object. The dispenser of the example is intended to make use of this effect for spraying personal products and a power pack 60 is provided for this purpose in the casing, separated from the flexible sac by a lower partition 62. The power pack comprises a battery-powered circuit for generating a high voltage, eg. 15 kV. Such circuits are well known and will not be further described here, though may be found further discussed and exemplified in EP501725 (Imperial Chemical Industries). the pack 60 can be slid into the open bottom end of the casing and a circumferential rib 64*a* on the periphery of the pack locks into the complementary recess 64*b* in the casing wall to secure the pack releasably.

The circuit within the power pack is connected to a series of terminal plates 68 accessible through apertures 70 in the pack end wall. Tubular channels 72*a*, 72*b*, 72*c* integrally formed on the inner wall of the casing have spring-loaded contact pins 74 held captive in their lower ends and the pins project through the casing end wall to make contact with the terminal plates 68 when the power pack is in place. On one side of the casing there is the single channel 72*a* which encloses a high-voltage wire 76 which extends into the interior of the outlet cap 12*a* of the sac. On the other side of the casing the pair of channels 72*b*, 72*c* contain respective wires 78*a*, 78*b* which are respectively attached to a pair of laterally spaced contacts 80*a*, 80*b* on the operating member 52.

A metal press button 84 for pivoting the operating member is mounted on a pivot 86 adjacent the operating member but is normally held spaced from the member by a spring 88. When the button is depressed by the user to displace the operating member 52 and pressure begins to be applied to the nozzle 46, the spring 88 is flexed and the push button 84 bridges the two contacts 80*a*, 80*b* to close the circuit through the wires 78*a*, 78*b*.

The contact the user makes with the metal push button 84 provides a ground for the circuit through the high tension wire into the material in the sac at its outlet cap 12*a* and the material being ejected is thereby electrically charged. The nozzle 46 has a suitably small orifice 46*a*, eg. 0.15 mm diameter, and the pressure forcing the material through it produces a spray in the form of a mist of very fine droplets. The high voltage electrostatic charge these now carry ensures that they are attracted towards that part of the body of the user to which the spray is directed since the user's body forms the ground for the circuit. The user is able in this way to obtain the full effect of the spray with minimum loss.

Because of the small droplet size and the effect of charging the droplets it is possible to use many personal products effectively in very small volumes. Furthermore, because of the use of the spring mechanism to pressurize the fluid it is possible to maintain the spray for some considerable time at a uniform low rate of flow.

In view of the relatively high voltages produced in the illustrated dispenser, it is desirable to take precautions to keep the user shielded from the circuitry. Although the power levels can be dept small enough to ensure no danger will result from contact with the high voltage side, the voltage level is sufficient to give an unpleasant shock. In the illustrated example, a barrier plate 90 projecting from the partition 4 separates the region of the press button from the region of the outlet valve. The high voltage wire 76 is located on the opposite side of the casing to the push button 84 and it can be completely shielded by the partition 4.

Figure 5:
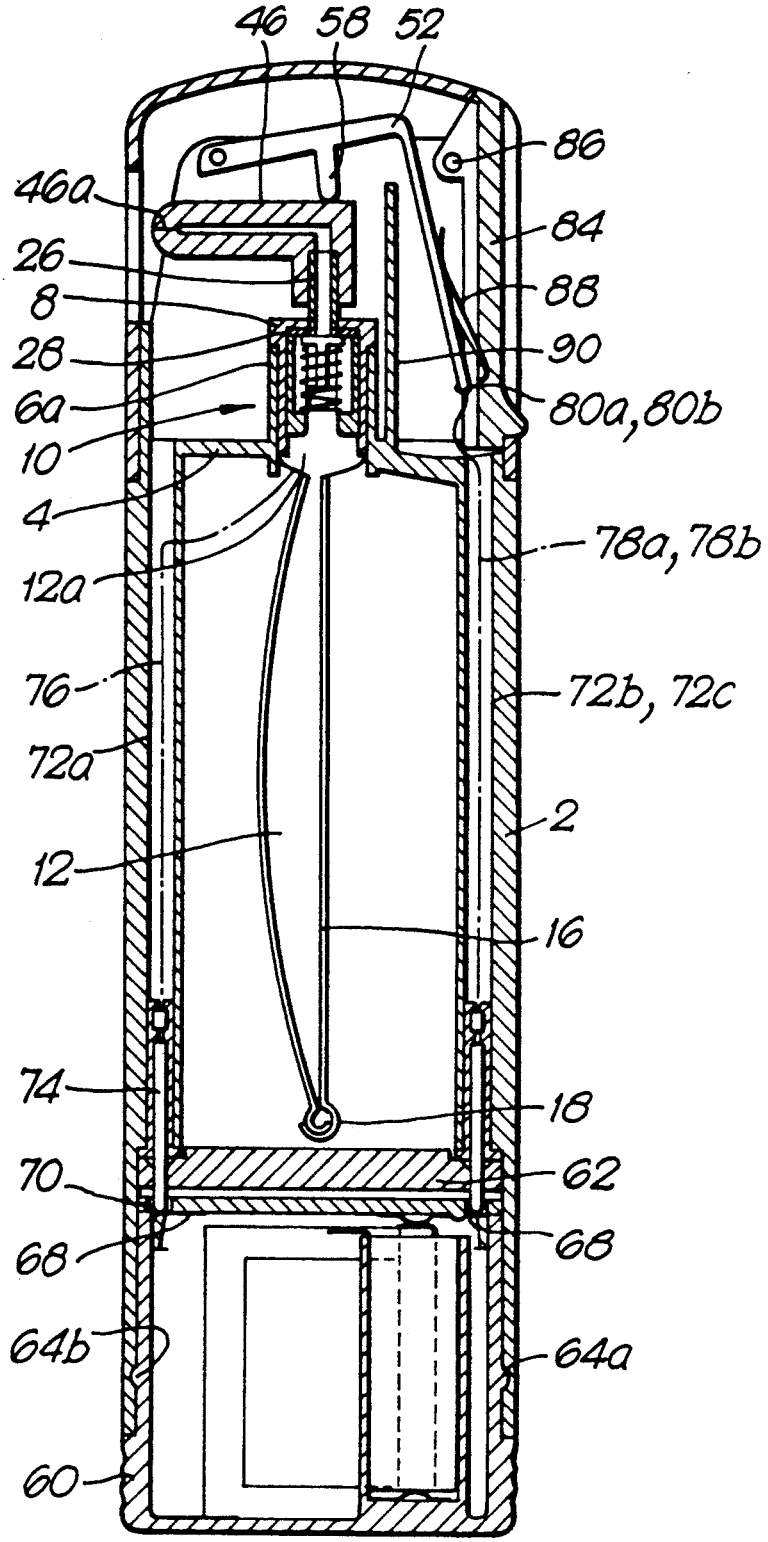
FIG. 5 illustrates a second embodiment similar to that shown by FIG. 1 but utilizing only a single leaf spring.

The resilient means for applying pressure to the sac can be arranged in a variety of ways. For example, a rigid or substantially rigid support can be provided on one side of the sac and a pre-stressed leaf spring on the other side. FIG. 5 illustrates this embodiment. Instead of leaf springs acting directly on the walls of the sac, they can act through substantially rigid members which thus have a predetermined contoured surface for engaging the container. If such rigid means are interposed between a sac and the or each spring, it may be more convenient to employ other forms of springs than leaf springs.

We claim:

1. A fluid dispenser comprising:

a casing;

closure valve means within said casing for controlling dispensing of a fluid material therefrom;

a spray outlet downstream from and communicating with said closure valve means for dispensing said fluid material;

a resilient means for placing said fluid material under pressure, said resilient means comprising a leaf spring and a cooperating member each having first and second ends, said first ends being disposed upstream and below said closure valve means, said first ends forming an open mouth through which said fluid material can flow toward said closure valve means, aid second ends being opposite said first ends and being locked together, and said cooperating member being selected from the group consisting of a further leaf spring and a non-resilient rigid support;

a deformable container capable of being filled with said fluid material to be dispensed, said deformable container being positioned between and deformable by said resilient means.

2. A dispenser according to claim 1, wherein said deformable container is a flexible walled sac.

3. A dispenser according to claim 1, wherein said deformable container is made of plastics material.

4. A dispenser according to claim 1, wherein said resilient means are a combination of said leaf spring and further leaf spring symmetrically disposed relative to one another.

5. A dispenser according to claim 4, wherein said leaf springs are locked together at said second ends by return bends.

6. A dispenser according to claim 1, wherein said cooperating member is said non-resilient rigid support.

7. A dispenser according to claim 1, further comprising:

a voltage generating means within said casing for applying an electrostatic charge to said fluid material;

a control means for actuating from outside said casing dispensing of said fluid material through said spray outlet and for simultaneously actuating said voltage generating means.

* * * * *